US009316048B2

(12) United States Patent
Janick et al.

(10) Patent No.: US 9,316,048 B2
(45) Date of Patent: Apr. 19, 2016

(54) DOOR PROTECTOR

(71) Applicant: CIW Enterprises, Inc., Mountaintop, PA (US)

(72) Inventors: James J. Janick, Hanover Township, PA (US); Milton Prosperi, Mountaintop, PA (US); Michelle Burrell, Harveys Lake, PA (US)

(73) Assignee: CIW Enterprises, Inc., Mountaintop, PA (US)

( * ) Notice: Subject to any disclaimer, the term of this patent is extended or adjusted under 35 U.S.C. 154(b) by 0 days.

(21) Appl. No.: 14/182,185

(22) Filed: Feb. 17, 2014

(65) Prior Publication Data

US 2014/0230334 A1 Aug. 21, 2014

Related U.S. Application Data

(60) Provisional application No. 61/766,050, filed on Feb. 18, 2013, provisional application No. 61/904,012, filed on Nov. 14, 2013.

(51) Int. Cl.

| | |
|---|---|
| ***E06B 9/08*** | (2006.01) |
| ***E06B 9/17*** | (2006.01) |
| *E01F 13/00* | (2006.01) |
| *E06B 9/15* | (2006.01) |

(52) U.S. Cl.

CPC ..... *E06B 9/17046* (2013.01); *E01F 13/00* (2013.01); *E06B 2009/1516* (2013.01)

(58) Field of Classification Search

CPC ..... E06B 9/17046; E06B 2009/1516; E06B 7/28; E06B 9/08; E06B 2009/135; E06B 9/13; E06B 5/10; E06B 5/113; E06B 2003/7044; B61L 29/02; E01F 13/00; E01F 13/046

USPC ..... 160/205, 201, 113, 209, 127, 89, 90, 160/119, 118; 49/197, 54, 65, 68, 9, 34, 70; 52/173.2

See application file for complete search history.

(56) References Cited

U.S. PATENT DOCUMENTS

| | | | | | |
|---|---|---|---|---|---|
| 660,903 | A * | 10/1900 | Kling | B61G 11/14 | 213/221 |
| 1,135,066 | A * | 4/1915 | Sonnichsen | B60R 19/285 | 293/137 |
| 1,233,887 | A * | 7/1917 | Lederer | B60R 19/28 | 293/137 |
| 1,314,800 | A * | 9/1919 | Halladay | B60R 19/28 | 293/137 |
| 1,321,655 | A * | 11/1919 | McKee | B60R 19/285 | 293/135 |
| 1,325,734 | A * | 12/1919 | Lyon | B60R 19/285 | 293/135 |
| 1,325,739 | A * | 12/1919 | Lyon | B60R 19/285 | 293/135 |
| 1,346,668 | A * | 7/1920 | Newton | B60R 19/28 | 293/118 |
| 1,396,057 | A * | 11/1921 | Ratterman | B60R 19/28 | 293/137 |
| 1,438,177 | A * | 12/1922 | Hatashita | B60R 19/28 | 293/137 |
| 1,472,700 | A * | 10/1923 | Vickery | B60R 19/42 | 293/127 |
| 1,548,087 | A * | 8/1925 | Heller | B60R 19/28 | 293/137 |
| 1,570,624 | A * | 1/1926 | Dominguez | B60R 19/32 | 293/134 |
| 1,807,132 | A * | 5/1931 | Pappas | B60R 19/32 | 267/225 |

(Continued)

*Primary Examiner* — Katherine Mitchell
*Assistant Examiner* — Johnnie A Shablack
(74) *Attorney, Agent, or Firm* — Mitchell A. Smolow

(57) ABSTRACT

An overhead coiling closure is presented. A repositionable impact bar assembly engages a guide bracket mounted adjacent to the coiling closure when the closure is in a closed position. When in an open position, the impact bar assembly is released from the guide bracket and attaches to the coiling closure to provide repositionable impact protection. As the coiling closure closes the impact bar assembly is once again engaged by the guide bracket.

24 Claims, 6 Drawing Sheets

(56) References Cited

U.S. PATENT DOCUMENTS 2,006,228 A * 6/1935 Collins ..... E05D 15/165 16/104
2,186,137 A * 1/1940 Halladay ..... B60R 19/28 293/137
2,883,714 A * 4/1959 May ..... E06B 7/28 16/277
3,433,520 A * 3/1969 Steinmetz ..... B60R 19/28 293/137
3,638,667 A * 2/1972 Frommelt ..... B65G 69/008 135/123
3,827,741 A * 8/1974 Howell ..... B60R 19/18 152/379.3
3,927,907 A * 12/1975 Bialek ..... B60R 19/26 267/30
3,997,208 A * 12/1976 Nomiyama ..... B60R 19/16 293/102
4,079,924 A * 3/1978 Persicke ..... B60R 19/32 188/288
4,082,338 A * 4/1978 Hutai ..... B60R 19/36 267/140
4,330,147 A * 5/1982 Nolen ..... 292/259 R
4,356,668 A * 11/1982 Wagner ..... 49/506
4,493,164 A * 1/1985 Wagner ..... 49/65
4,856,831 A * 8/1989 Roden, Jr. ..... 292/259 R
5,031,947 A * 7/1991 Chen ..... B60R 19/02 267/139
5,077,940 A * 1/1992 LaRose, Jr. ..... 49/503
5,335,452 A * 8/1994 Taylor ..... E06B 5/12 49/463
5,364,140 A * 11/1994 Rice ..... 292/259 R
5,383,315 A * 1/1995 Birs ..... E06B 9/02 49/49
5,408,789 A * 4/1995 Plfeger ..... 52/173.2
5,496,081 A * 3/1996 Rice ..... 292/259 R
5,564,238 A * 10/1996 Ellis ..... 52/173.2
5,605,364 A * 2/1997 Shelledy ..... 292/259 R
5,622,397 A * 4/1997 Rice et al. ..... 292/259 R
5,649,396 A * 7/1997 Carr ..... 52/174
5,673,741 A * 10/1997 Cairns ..... 160/330
5,803,517 A * 9/1998 Shibuya ..... B60R 19/18 293/120
6,042,163 A * 3/2000 Reiffer ..... B60R 19/18 293/102
6,279,276 B1 * 8/2001 Knoll ..... 52/173.2
6,644,699 B2 * 11/2003 Anderson ..... B60R 19/04 293/102
6,654,976 B2 * 12/2003 Digmann ..... B65G 69/2876 14/69.5
6,726,260 B1 * 4/2004 Wang ..... B60R 19/12 293/117
6,733,055 B2 * 5/2004 Iino ..... B60R 19/18 293/102
6,764,118 B2 * 7/2004 DePottey ..... B60R 19/40 293/118
6,896,303 B1 * 5/2005 Mohr ..... B60D 1/06 293/117
6,902,141 B2 * 6/2005 Kirby ..... E06B 9/50 160/323.1
6,915,832 B2 * 7/2005 Stern, Jr. ..... 160/205
6,923,484 B2 * 8/2005 Braun ..... B60R 19/24 293/132
6,988,753 B1 * 1/2006 Omura ..... B60R 19/18 293/13
7,029,044 B2 * 4/2006 Browne ..... B60R 19/03 267/175
7,370,686 B2 * 5/2008 Rasmussen ..... E06B 9/50 160/323.1
7,628,430 B2 * 12/2009 Whitaker ..... 292/259 R
7,661,733 B1 * 2/2010 Angel ..... 292/259 R
7,775,252 B2 * 8/2010 Snyder et al. ..... 160/113
7,823,620 B2 * 11/2010 Kirby ..... E06B 9/50 160/309
8,100,444 B2 * 1/2012 Erzgraber ..... B60R 19/18 293/115
8,505,990 B2 * 8/2013 Czopek ..... B60R 19/18 293/102
8,708,380 B2 * 4/2014 Tsuchida ..... B60R 19/18 293/102
8,770,636 B2 * 7/2014 Shimotsu ..... B60R 19/18 293/102
8,844,986 B2 * 9/2014 Kaneko ..... B60R 19/34 293/133
9,027,280 B2 * 5/2015 Huddleston ..... E05C 21/00 49/62
2002/0113447 A1 * 8/2002 Frank ..... B60R 19/34 293/133
2006/0086874 A1 * 4/2006 Habel ..... E06B 9/174 248/268
2008/0110218 A1 * 5/2008 Allen ..... E06B 9/02 70/158
2010/0052342 A1 * 3/2010 Wurtemberger ..... B62D 25/082 293/132
2010/0212227 A1 * 8/2010 Perkins et al. ..... 49/70
2010/0229467 A1 * 9/2010 Perkins et al. ..... 49/9
2010/0244470 A1 * 9/2010 Wacker ..... B60R 19/18 293/132
2011/0147326 A1 * 6/2011 Woolley, II ..... A47K 3/38 211/105.6
2011/0192949 A1 * 8/2011 Zimmerman ..... A47H 1/18 248/261
2013/0187396 A1 * 7/2013 Brockhoff ..... B21D 53/88 293/146
2013/0313392 A1 * 11/2013 Sanchuk ..... A47H 2/00 248/254
2014/0230334 A1 * 8/2014 Janick et al. ..... 49/460
2014/0367984 A1 * 12/2014 Blumel ..... B60R 19/34 293/132

* cited by examiner

FIG 2
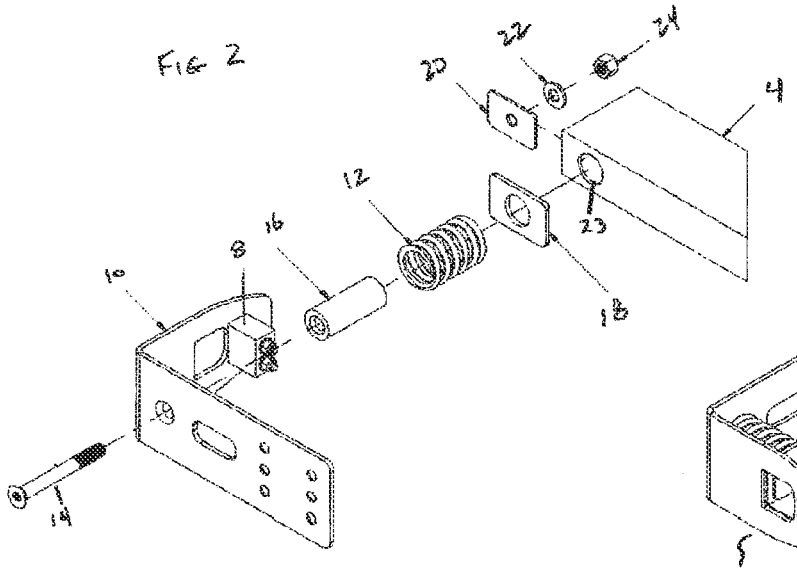
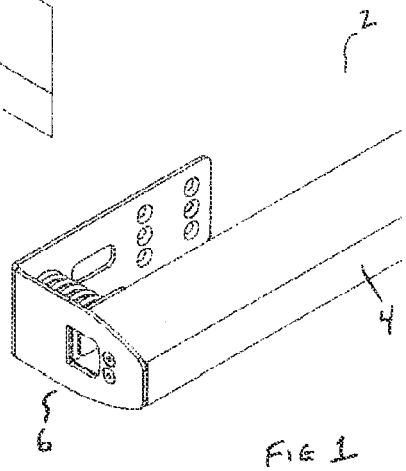
FIG 1
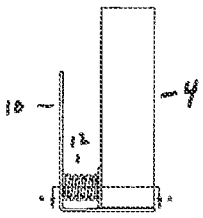
FIG 3
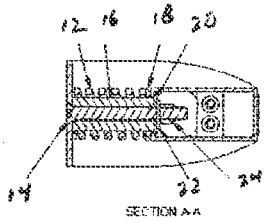
FIG 4

FIG 6
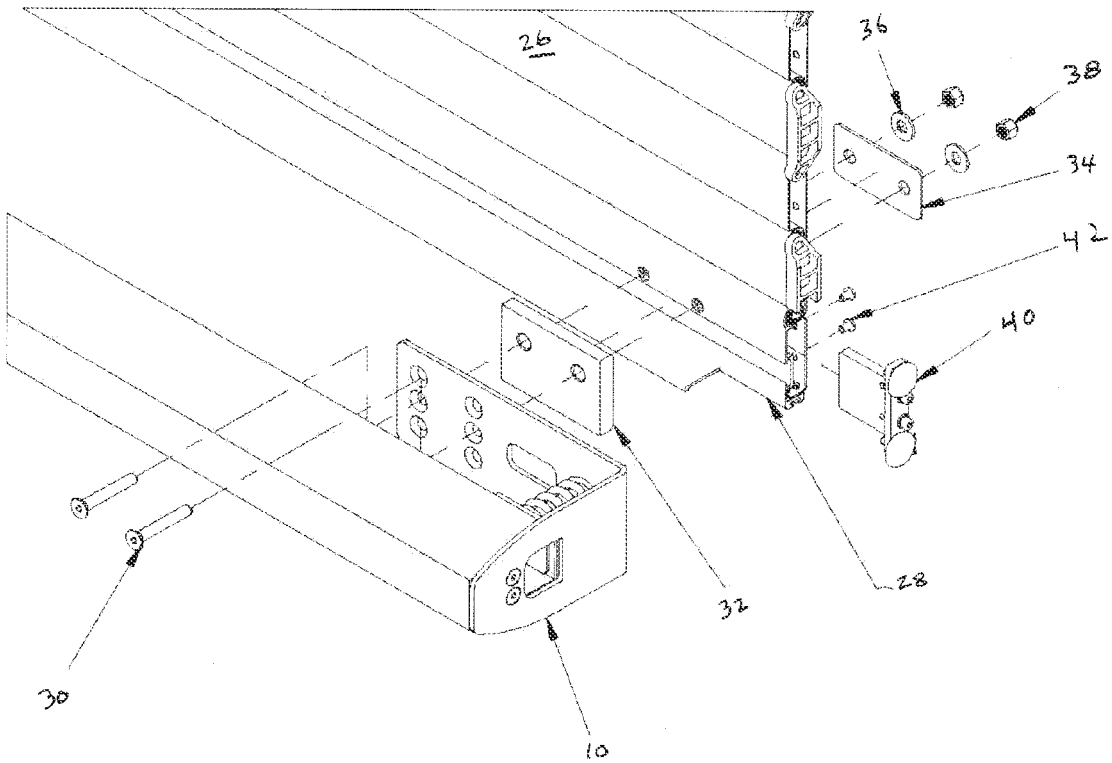
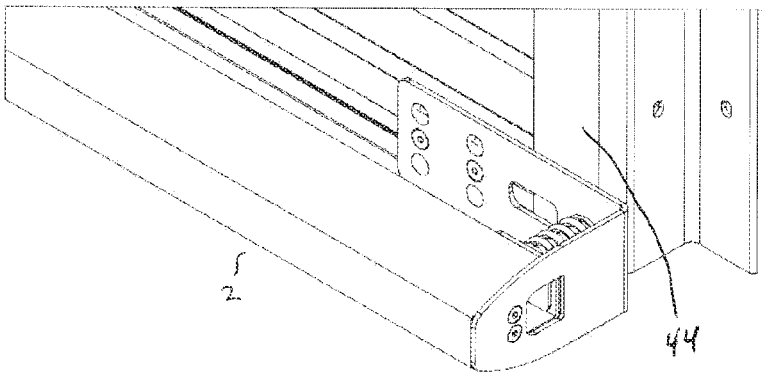
FIG 7

DOOR PROTECTOR

CROSS REFERENCE TO RELATED APPLICATIONS

This application claims benefit of U.S. Provisional Application No. 61/766,050 filed Feb. 18, 2013 and U.S. Provisional Application No. 61/904,012 filed Nov. 14, 2013.

FIELD OF THE INVENTION

This invention relates generally to impact protection for overhead closures and in particular, to impact protection for an overhead coiling door.

BACKGROUND OF THE INVENTION

Access openings in warehouse, manufacturing and industrial settings are often secured by overhead (vertically traveling) closures.

Rolling steel doors, also referred to as overhead coiling closures, are metal slatted doors which move in a generally vertical path coiling above the opening as the door is opened. Because rolling steel doors have many fewer parts than sectional doors with less risk for damage and inoperability they often make a better solution for facilities that cannot afford opening downtime.

An overhead coiling closure is either provided with a powered operator to power the door to an open or closed position or it is manually opened and closed with, for example, a looped chain or crank. A shaft is horizontally mounted above the access opening to wind or unwind the coiling closure while the door sides are maintained within tracks mounted to the building structure on either side of the access opening. The coiling shaft and operator (if present) are usually covered and protected by a hood.

When doors are installed in high traffic areas, for example, shipping and receiving areas, the door can be damaged if struck by, for example, a fork lift transporting cargo. This damage can be caused not only by the forklift itself but also by the cargo being trucked by the lift. If the door becomes damaged the coiling closure may become non-operational with resultant access opening downtime.

Accordingly, there is still a continuing need for improved door protection designs. The present invention fulfills this need and further provides related advantages.

BRIEF SUMMARY OF THE INVENTION

In a first embodiment an impact bar assembly is fixedly mounted to an overhead coiling door.

In a second embodiment an impact bar assembly is repositionally mounted to an overhead coiling door.

One advantage of the present invention is the prevention of damage to the overhead coiling closure obviating the need for repair or replacement.

Another advantage is the reduction in access opening downtime due to damage of the overhead coiling closure from impact force strikes.

Yet another advantage is the automatic resetting of the impact bar assembly to the protective, starting position removing the need to restrict use of the access opening during a manual reset.

Other features and advantages of the present invention will be apparent from the following more detailed description of the preferred embodiments, taken in conjunction with the accompanying drawings which illustrate, by way of example, the principles of the invention.

BRIEF DESCRIPTION OF THE DRAWINGS

The accompanying drawings are included to provide a further understanding of the present invention. These drawings are incorporated in and constitute a part of this specification, illustrate one or more embodiments of the present invention, and together with the description, serve to explain the principles of the present invention.

FIG. 1 is a perspective view of the bumper bar mounted to the impact guide bracket assembly.

FIG. 2 is an exploded perspective view of the bumper bar and impact guide assembly bracket mounting.

FIG. 3 is a top view of the bumper bar mounted to the impact guide bracket assembly.

FIG. 4 is a sectional view of the bumper bar mounted to the impact guide bracket assembly taken at A-A of FIG. 3.

FIG. 6 is an exploded perspective view of a fixedly mounted impact bar assembly with the guide assembly removed.

FIG. 7 is a perspective view of a fixedly mounted impact bar assembly with the guide assembly in place.

Figure 5:
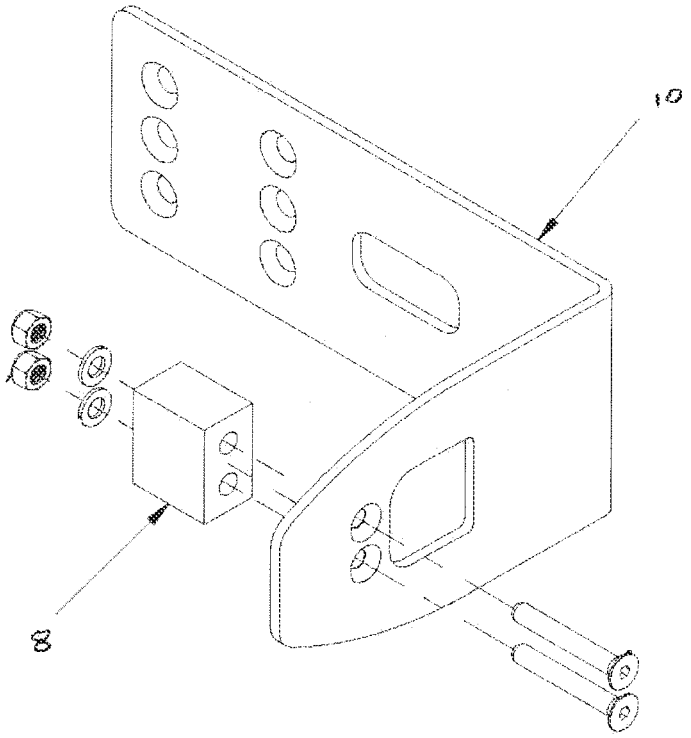
FIG. 5 is an exploded perspective view of the guide block mounted to the stationary bracket.

Other features and advantages of the present invention will be apparent from the following more detailed description of the preferred embodiments, taken in conjunction with the accompanying drawings which illustrate, by way of example, the principles of the invention.

DETAILED DESCRIPTION OF THE INVENTION

As required, detailed embodiments of the present invention are disclosed; however, it is to be understood that the disclosed embodiments are merely exemplary of the invention that may be embodied in various forms. The figures are not necessary to scale, and some features may be exaggerated to show details of particular components. Therefore, specific structural and functional details disclosed are not to be interpreted as limiting, but merely as a basis for the claims and as a representative basis for teaching one skilled in the art to variously employ the present invention. Where possible, like reference numerals have been used to refer to like parts in the several alternative figures.

Turning now to FIG. 1, in an embodiment used with, for example, a rolling steel door, impact bar assembly 2 comprises a bumper bar 4 translationally mounted at each end to an impact guide bracket assembly 6. Although only one end is shown, it is to be understood that the other end has the same geometry and, therefore, will not be separately described.

FIGS. 2-5 more fully show the component parts of the impact guide bracket assembly 6. A bumper bar engagement member, for example, guide block 8 is mounted to a first leg of a stationary bracket 10. Mounted to the second leg of the stationary bracket 10 is a resistance element, for example, a spring 12, mounted via bolt 14 and spring shaft 16.

As shown in FIGS. 2-4, a guide block 8 is retained within a hollow end of bumper bar 4 and translationally retains the bumper bar 4 to the impact guide bracket assembly 6. A bolt 14 passes through the spring shaft 16 which in turn passes through the spring 12 and is received through bumper bar orifice 23. A thrust plate 18 and retaining plate 20 are mounted outside and within the hollow end of the bumper bar 4, respectively, to translationally fix the bumper bar 4 to the stationary bracket 10. This permits an impact force directed against the bumper bar 4 to be dissipated by the spring 12 which subsequently returns the bumper bar 4 to its starting position, determined by the guide block 8.

The impact force is ultimately translated to the guide assembly 44 to relieve the impact force from the door curtain itself. The stationary bracket 10 is positioned such that the spring 12 is effectively located over the guide assembly 44 to protect the rolling steel door 26 throughout the opening and closing range of motion.

Figure 8:
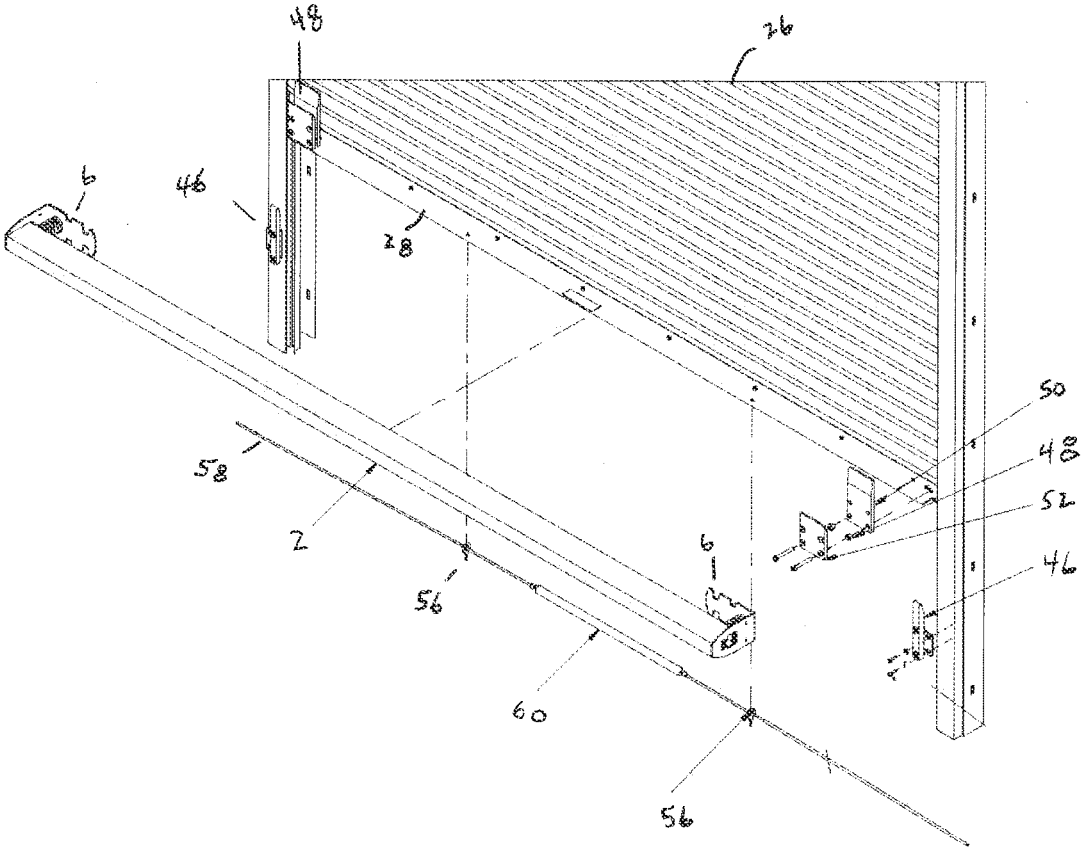
FIG. 8 is an exploded perspective view of a positionally mounted impact bar assembly.
Figure 9:
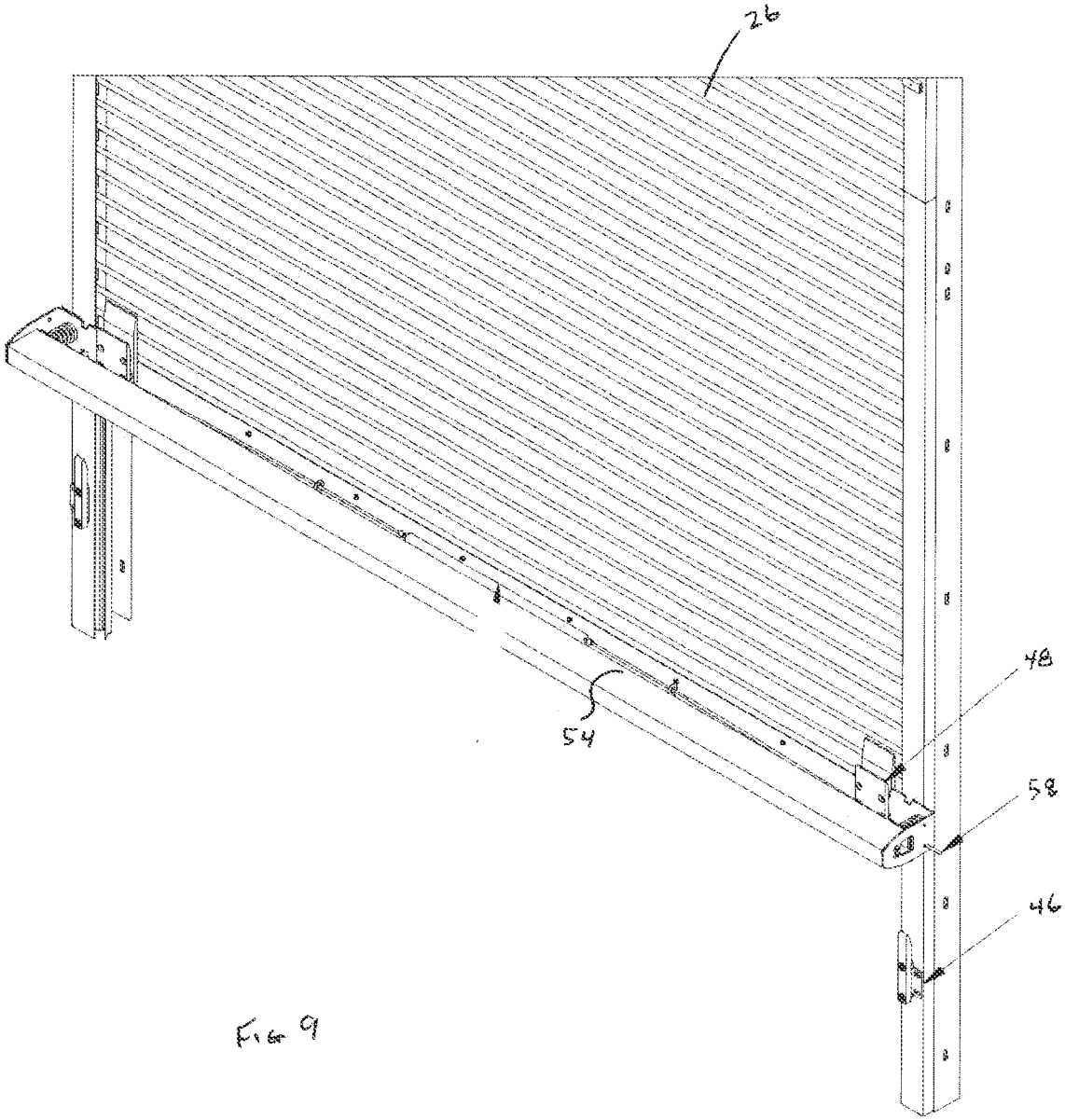
FIG. 9 is a perspective view of a positionally mounted impact bar assembly in a partially opened door position.
Figure 10:
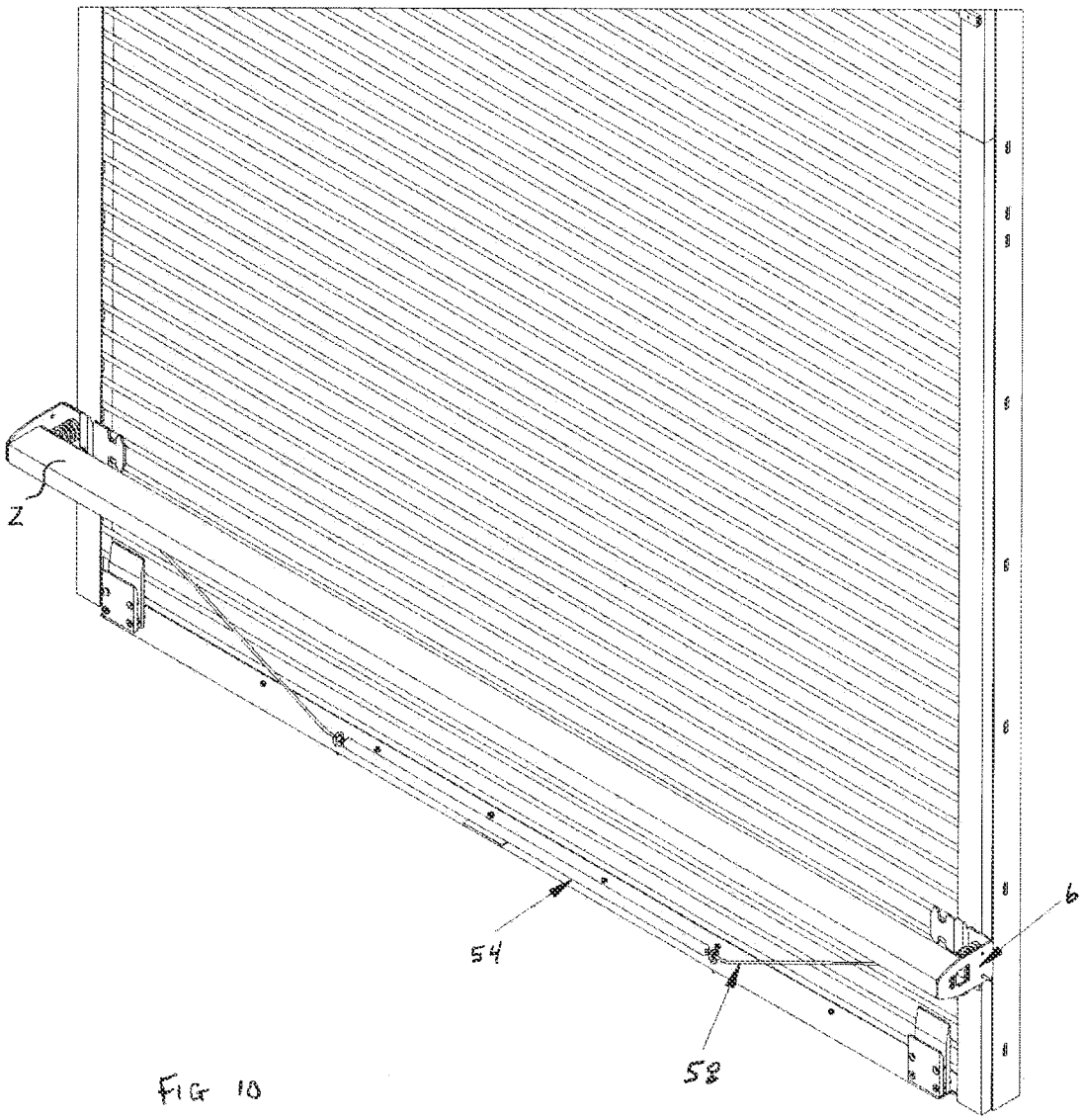
FIG. 10 is a perspective view of a positionally mounted impact bar assembly in a closed door position.

The impact bar assembly 2 may be fixedly mounted to the rolling steel door 26 as shown in FIGS. 6 and 7, or it may be repositionally mounted as shown in FIGS. 8-10 described in detail below.

Turning now to FIGS. 6 and 7, the impact bar assembly 2 is fixedly mounted to the rolling steel door 26, for example, at each end of the rolling steel door bottom bar 28 via bolts 30 which pass through the second leg of the stationary bracket 10, a bottom bar adapter 32, the bottom bar 28, retaining plate 34, and flat washer 36 to engage nut 38.

FIG. 6 is drawn with the guide assembly 44 of FIG. 7 removed for clarity. The bearing assembly 40 is mounted to the bottom bar 28 with button head cap screws 42. The bearings counteract the moment created by the impact bar assembly 2 when the door 26 is in motion and reduce friction between the bottom bar 28 and the guide assembly 44. An impact force is always absorbed by the spring 12 and transferred through the stationary bracket 10 and into the guide assemblies 44.

Turning now to FIGS. 8-10 which show the repositional mounting of impact bar assembly 2, an impact bar assembly retaining element, for example, a guide bracket 46 is mounted at each side of the rolling steel door 26, for example, to each guide assembly 44 at a user determined height. Described in detail below, the location of the guide brackets 46 permits retention of the impact bar assembly 2 at a closed door user defined location different from that of the fixedly positioned bottom bar 28 location shown in FIGS. 6 and 7.

A bottom bar retaining member, for example, a bottom bar bracket assembly 48 is mounted to the rolling steel door 26, for example, mounted at each side of the bottom bar 28. Bottom bar bracket assembly 48 comprises a first 50 and second 52 leg with effective spacing therebetween to releasably engage the impact guide bracket assembly 6.

In use, with the rolling steel door 26 fully closed (FIG. 10), the impact bar assembly 2 is releasably mounted to the guide brackets 46 by releasably inserting the impact guide bracket assembly 6 into the guide brackets 46. As the rolling steel door 26 is opened the bottom bar bracket assemblies 48 releasably engage the impact guide bracket assemblies 6 to lift the impact bar assembly 2 off the guide brackets 46 thereby raising the impact bar assembly 2 upward with the bottom bar 28 to allow passage through the door opening while continuing to provide rolling steel door 26 impact protection.

When the rolling steel door 26 is closed, upon reaching the guide brackets 46, the impact guide bracket assemblies 6 re-engage the guide brackets 46 and the impact bar assembly 2 is released from the bottom bar bracket assemblies 48 and is once again maintained in the guide brackets 46 as the rolling steel door 26 continues to close.

Optionally, an impact bar retainer, for example, an extension spring assembly 54 is employed to prevent the impact bar assembly 2 from lifting off the guide brackets 46 when not being engaged by the bottom bar bracket assemblies 48. The extension spring assembly 54 (FIG. 9) comprises, for example, a plurality of fasteners, for example, eye bolts 56 mounted to the bottom bar 28 (FIG. 8). Passing through the eye bolts 56 are steel cables 58 fixed at one end to an extension spring 60 with each cable other end engaging an impact guide bracket assembly 6 (FIG. 9). As shown in FIG. 10, when the rolling steel door 24 is closed and the impact bar assembly 2 is engaged within the guide brackets 46, the steel cables 58 are deflected and in combination with the extension spring 60 maintain a retaining pressure on the impact guide bracket assemblies 6 to help retain the impact bar assembly 2 within the guide brackets 46.

As the rolling steel door 26 opens and the impact bar assembly 2 is lifted off the guide brackets 46, the extension spring 60 in its retracted position pulls the cables 58 towards the center of the rolling steel door 26 to help retain the impact bar assembly 2 within the bottom bar bracket assemblies 48.

Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

What is claimed is:

1. An impact bar assembly comprising:

a bumper bar having a first end and a second end;

a bumper bar engagement member fixed to an impact guide bracket assembly, wherein the bumper bar engagement member is fully encased and non-removably retained within a bumper bar hollow area such that the bumper bar is translationally movable with respect to the impact guide bracket and unsecured to the bumper bar engagement member, wherein the bumper bar engagement member defines the limit of bumper bar translational movement; and a resistance element positioned between the bumper bar and the impact guide bracket assembly.

2. The impact bar assembly of claim 1 wherein the bumper bar engagement member is retained within a hollow end of the bumper bar.

3. The impact bar assembly of claim 2 wherein the bumper bar engagement member comprises a guide block.

4. The impact bar assembly of claim 2 wherein the impact guide bracket assembly comprises a stationary bracket having a first and second leg, the bumper bar engagement member is mounted to the first leg, and the resistance element is mounted to the second leg.

5. The impact bar assembly of claim 4 wherein the bumper bar engagement member comprises a guide block and the resistance element comprises a spring mounted via a bolt and spring shaft, the bolt passing through the spring shaft, the spring shaft passing through the spring, and the bolt retentively received through a bumper bar orifice.

6. The impact bar assembly of claim 5 wherein each bumper bar end includes its own bumper bar engagement member and resistance element.

7. An overhead coiling closure comprising:

an operative coiling closure;

a first and second coiling closure guide assembly, the first and second coiling closure guide assembly respectively positioned on each side of the coiling closure; and an impact bar assembly attached to the coiling closure, the impact bar assembly comprising:

a bumper bar having a first end and a second end;

a bumper bar engagement member fixed to an impact guide bracket assembly, wherein the bumper bar engagement member is fully encased and non-removably retained within a bumper bar hollow area such that the bumper bar is translationally movable with respect to the impact guide bracket and unsecured to the bumper bar engagement member, wherein the bumper bar engagement member defines the limit of bumper bar translational movement; and a resistance element positioned between the bumper bar and the impact guide bracket assembly.

8. The overhead coiling closure of claim 7 wherein the bumper bar engagement member is retained within a hollow end of the bumper bar and the resistance element is effectively located over at least one of the guide assemblies.

9. The overhead coiling closure of claim 8 wherein the bumper bar engagement member comprises a guide block.

10. The overhead coiling closure of claim 8 wherein the impact guide bracket assembly comprises a stationary bracket having a first and second leg, the bumper bar engagement member is mounted to the first leg, and the resistance element is mounted to the second leg.

11. The overhead coiling closure of claim 10 wherein the bumper bar engagement member comprises a guide block and the resistance element comprises a spring mounted via a bolt and spring shaft, the bolt passing through the spring shaft, the spring shaft passing through the spring, and the bolt retentively received through a bumper bar orifice.

12. The overhead coiling closure of claim 11 wherein each bumper bar end includes its own bumper bar engagement member and resistance element.

13. The overhead coiling closure of claim 12 wherein the stationary bracket is mounted to a coiling closure bottom bar, the bottom bar comprising a first and second bearing assembly operatively retained within the respective first and second coiling closure guide assembly.

14. An overhead coiling closure comprising:

an operative coiling closure;

a first and second coiling closure guide assembly, the first and second coiling closure guide assembly respectively positioned on each side of the coiling closure;

an impact bar assembly retaining element mounted adjacent to the overhead coiling closure;

a coiling closure bracket assembly mounted to the coiling closure; and an impact bar assembly releasably attachable from both the impact bar assembly retaining element and the coiling closure bracket assembly, the impact bar assembly comprising:

a bumper bar having a first end and a second end;

a bumper bar engagement member fixed to an impact guide bracket assembly, wherein the bumper bar engagement member is fully encased and non-removably retained within a bumper bar hollow area such that the bumper bar is translationally movable with respect to the impact guide bracket and unsecured to the bumper bar engagement member, wherein the bumper bar engagement member defines the limit of bumper bar translational movement; and a resistance element positioned between the bumper bar and the impact guide bracket assembly.

15. The overhead coiling closure of claim 14 wherein the bumper bar engagement member is retained within a hollow end of the bumper bar and the resistance element is effectively located over at least one of the guide assemblies.

16. The overhead coiling closure of claim 15 wherein the bumper bar engagement member comprises a guide block.

17. The overhead coiling closure of claim 15 wherein the impact guide bracket assembly comprises a stationary bracket having a first and second leg, the bumper bar engagement member is mounted to the first leg, and the resistance element is mounted to the second leg.

18. The overhead coiling closure of claim 17 wherein the bumper bar engagement member comprises a guide block and the resistance element comprises a spring mounted via a bolt and spring shaft, the bolt passing through the spring shaft, the spring shaft passing through the spring, and the bolt retentively received through a bumper bar orifice.

19. The overhead coiling closure of claim 18 wherein each bumper bar end includes its own bumper bar engagement member and resistance element.

20. The overhead coiling closure of claim 19 wherein the impact bar assembly retaining element is a guide bracket mounted to the guide assembly and the coiling closure bracket assembly is mounted to a coiling closure bottom bar, the bottom bar comprising a bearing assembly operatively retained within the guide assembly.

21. The overhead coiling closure of claim 20 further comprising an impact bar retainer attached to each impact bar assembly end.

22. The overhead coiling closure of claim 21 wherein the impact bar retainer comprises a plurality of fasteners mounted to the bottom bar; a pair of cables freely held by the fasteners, the cables operatively engaged by an extension spring at their first end and engaging the impact guide bracket assembly at their second end.

23. A method of providing impact protection to an overhead coiling closure comprising the steps of:

attaching an impact bar assembly retaining element adjacent to the overhead coiling closure;

attaching a coiling closure bracket assembly to the coiling closure; and providing an impact bar assembly; wherein the impact bar assembly comprises:

a bumper bar having a first end and a second end;

a bumper bar engagement member fixed to an impact guide bracket assembly, wherein the bumper bar engagement member is fully encased and non-removably retained within a bumper bar hollow area such that the bumper bar is translationally movable with respect to the impact guide bracket and unsecured to the bumper bar engagement member, wherein the bumper bar engagement member defines the limit of bumper bar translational movement; and a resistance element positioned between the bumper bar and the impact guide bracket assembly.

24. The method of claim 23 wherein an impact bar assembly stationary bracket is positioned such that an impact bar assembly resistance element operatively connected to the stationary bracket is effectively located over a guide assembly to translate an impact force to the guide assembly.

* * * * *